US006635111B1

(12) United States Patent
Holtmann et al.

(10) Patent No.: US 6,635,111 B1
(45) Date of Patent: Oct. 21, 2003

(54) CONTACTLESS GUIDE SYSTEM FOR CONTINUOUS WEB

(75) Inventors: Bruno Holtmann, Dielsdorf (CH); Konrad Dessovic, Wallisellen (CH); José Antonio Mena, Bülach (CH)

(73) Assignee: Bachofen & Meier AG Maschinenfabrik, Bulach (CH)

( * ) Notice: Subject to any disclaimer, the term of this patent is extended or adjusted under 35 U.S.C. 154(b) by 0 days.

(21) Appl. No.: 09/857,112

(22) PCT Filed: Dec. 6, 1999

(86) PCT No.: PCT/EP99/09530

§ 371 (c)(1),
(2), (4) Date: May 30, 2001

(87) PCT Pub. No.: WO00/39011

PCT Pub. Date: Jul. 6, 2000

(30) Foreign Application Priority Data

Dec. 23, 1998 (DE) ..... 198 59 619
Jan. 26, 1999 (DE) ..... 199 02 936

(51) Int. Cl.[7] ..... B65H 20/00

(52) U.S. Cl. ..... 118/325; 226/95; 226/196.1; 226/97.3; 118/58; 34/640

(58) Field of Search ..... 118/325, 420, 118/500, 77, 117–118, 122–123, 234–235, 419, 58; 242/615.11, 615.12; 226/95, 97.3, 97.1, 97.2, 196.1; 34/640, 643

(56) References Cited

U.S. PATENT DOCUMENTS 3,874,030 A * 4/1975 Knight ..... 28/282
4,925,080 A 5/1990 Crouse et al.
5,230,165 A 7/1993 Beisswanger
5,423,468 A * 6/1995 Liedtke ..... 226/97
6,125,754 A * 10/2000 Harris ..... 226/97.3

FOREIGN PATENT DOCUMENTS

| | | |
|---|---|---|
| DE | 1215465 | 4/1966 |
| DE | 27 52 574 A1 | 6/1978 |
| DE | 43 34 473 A1 | 4/1995 |
| EP | 0 364 392 A2 | 4/1990 |
| EP | 0 379 685 A2 | 8/1990 |
| EP | 0705785 | 4/1996 |
| GB | 2 126 974 A | 4/1984 |

* cited by examiner

*Primary Examiner*—Richard Crispino
*Assistant Examiner*—Y. T. Tadesse
(74) *Attorney, Agent, or Firm*—Herbert Dubno Andrew Wilford

(57) ABSTRACT

Known devices for contactlessly guiding or treating continuous lines of material (1) have one chamber (2). A supply device (3) for a gaseous fluid is connected to said chamber (2), which has a gas-permeable wall (4). The outer surface (5) of said wall (4) is embodied as a guide surface for the line (1). According to the invention, the gas-permeable wall (4) is produced from a porous, metal-containing material with open pores which have an average diameter of less than 500 $\mu$m, preferably less than 100 $\mu$m, especially less than 20 $\mu$m. The porous material used for the guiding surface enables the line (1) to glide on a fluid pad of less than 1 mm. The losses of fluid on the surfaces not covered by the line (1) are very low.

14 Claims, 8 Drawing Sheets

CONTACTLESS GUIDE SYSTEM FOR CONTINUOUS WEB

CROSS REFERENCE TO RELATED APPLICATIONS

This application is the U.S. national phase of PCT application PCT/EP99/09530) filed Dec. 6, 1999 with a claim to the priority of German patent application 19859619.7 itself filed Dec. 23, 1998 and German patent application 19903936.9 itself filed Jan. 26, 1999.

FIELD OF THE INVENTION

The invention relates to an apparatus for contact-free guiding or treating a moving material web, in particular a paper or cardboard web or a metal or plastic foil, where the material web is supported on a gaseous fluid cushion according to the introductory clause of claim 1. Furthermore the invention relates to a coating apparatus that uses the apparatus according to the invention for supporting the material web, a dryer and a rewetting apparatus wherein the apparatus according to the invention is used to maintain moisture content of a material web at a certain level, and a web-storage system and web spreading apparatus for material webs.

BACKGROUND OF THE INVENTION

In treatment systems for material webs it is often necessary to guide and support the web without contacting it; for example in coating equipment when the still-wet web must be supported on its coated side. To this end for example deflecting/guiding systems are known that are formed of a hollow body with an arcuate outer surface provided with nozzles through which compressed air moves outward from inside the hollow body. The web thus floats on a cushion of air above the outer support surface. German 2,252,574 describes a similar deflecting/guiding apparatus that has a chamber to which compressed air is fed and which has a gas-permeable wall whose outer surface is formed as the guide surface for the web. With this known deflecting/guiding apparatus the air cushion is several millimeters thick. The compressed air moves from inside through openings formed as nozzles so that large quantities of compressed air are needed and as a result there are substantial pressure losses at regions not covered by the web.

OBJECT OF THE INVENTION

It is an object of the invention to improve an apparatus of the described type for guiding and treating a moving material web to ensure contact-free guiding of the web over the guide surface using and losing small amounts of support fluid.

This object is attained with the features of claim 1.

According to the invention the gas-permeable wall of the chamber, whose outer surface serves as guide surface for the web, is made of a metal-containing material whose open pores have an average diameter of less than 500 $\mu$m, preferably less than 100 $\mu$m, and in particular less than 20 $\mu$m.

The use of the porous material for the guide surface makes it possible to slide the web on a fluid cushion less than 1 mm thick. Losses of the gaseous fluid on the regions not covered by the web are quite minimal. A further advantage is that a porous material is automatically cleaned by the gaseous fluid. Coating materials that drip on the guide surface are carried away by the produced fluid cushion without clogging the pores.

According to the preferred embodiment according to claim 1 the material for the gas-permeable wall is a porous composite of a thermosetting resin and metal, preferably a composite of a thermosetting resin and aluminum. The grain of such composites has nondirectionally distributed open pores that form branching passages through the material. The gaseous fluid flows very uniformly through the walls. In addition the material is of stable shape and is easy to work.

A material with a percentage of open pores on the outer surface of the gas-permeable wall of less than 20%, preferably less than 10%, has shown itself particularly ideal with respect to the low relationships and the pressure cushion formed.

BRIEF DESCRIPTION OF THE DRAWING

The drawings serve for describing the invention with reference to simplified illustrated embodiments. Therein.

EMBODIMENTS OF THE INVENTION

Figure 2:
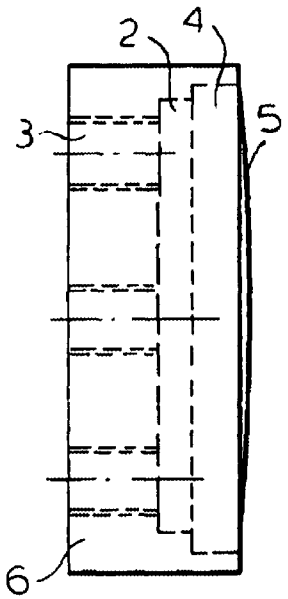
FIG. 2 is a cross section through the apparatus of FIG. 1.
Figure 1:
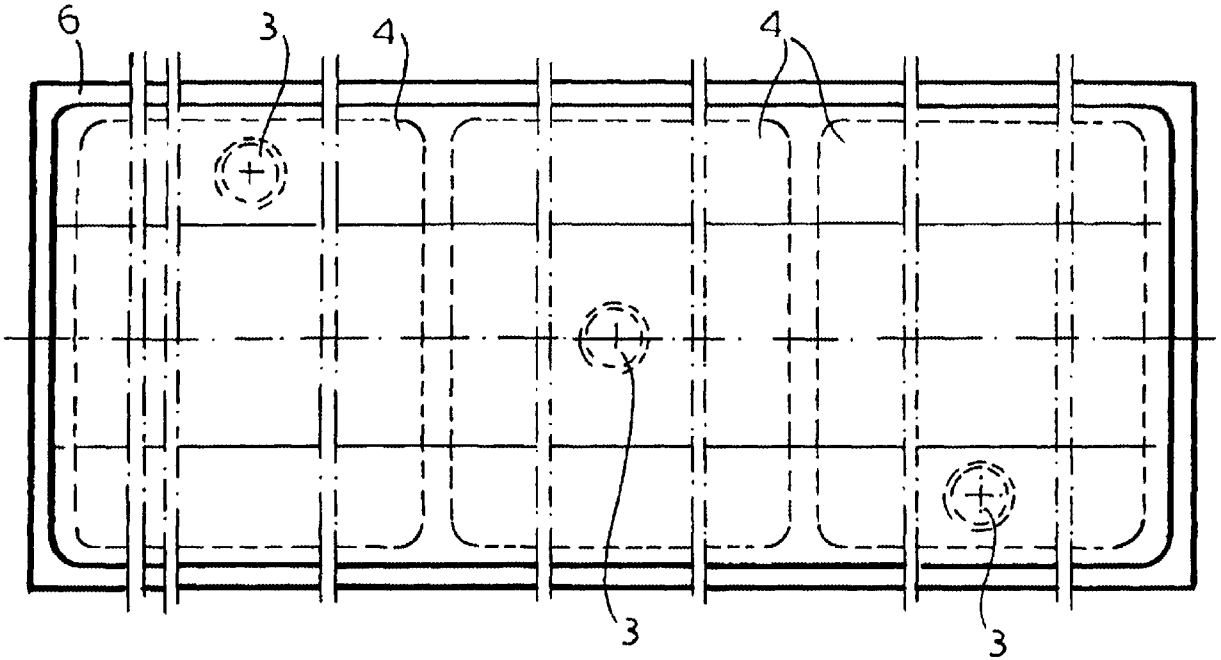
FIG. 1 is a top view of a gas-permeable wall of the chamber of a support device with a planar guide surface.

The apparatus shown in FIGS. 1 and 2 serves for the contact-free guiding and supporting of a moving material web 1 in a coating system. It can preferably be used in all treatment systems for flexible material webs, in particular paper or cardboard webs or plastic or metal foils, where the moving material web must be guided and/or supported without contact or friction.

The apparatus has one or more chambers 2 in each of whose back walls is an inlet 3 for a gaseous fluid. In systems for guiding or supporting a web 1 the gaseous fluid is compressed air while in the wetting device according to FIG. 5 steam or a steam/air mixture is used.

The side of the chamber 2 remote from the inlets 3 is closed by a plate-shaped gas-permeable wall 4 that is formed of a porous metal-containing material. The material has uniformly distributed open pores with an average diameter of less than 500 $\mu$m, preferably less than 100 $\mu$m and in particular less than 20 $\mu$m. It has been found particularly advantageous to use an average pore diameter from 10 $\mu$m to 20 $\mu$m. Preferably the material for the gas-permeable wall 4 is a porous composite of a thermosetting resin and metal, in particular a thermosetting-resin/aluminum composite with the described pore sizes. An outer face 5 of the wall 4 is formed as a guide surface for the web 1. Preferably the open pores account for less than 20% of the overall surface 5, in particular less than 10%.

The inlet lines 3 with the chamber 2 and the wall 4 are held in a frame 6 that is fixed rigidly on the frame of the treatment machine, in particular a coating machine.

The outer surface 5 of the wall 4 is in the embodiment of FIGS. 1 and 2 a plane. This shape of the outer surface 5 is preferably chosen when the apparatus serves for planar support of the web 1 in a treatment system, as shown in FIG. 3 by way of example in a coating system.

Figure 3:
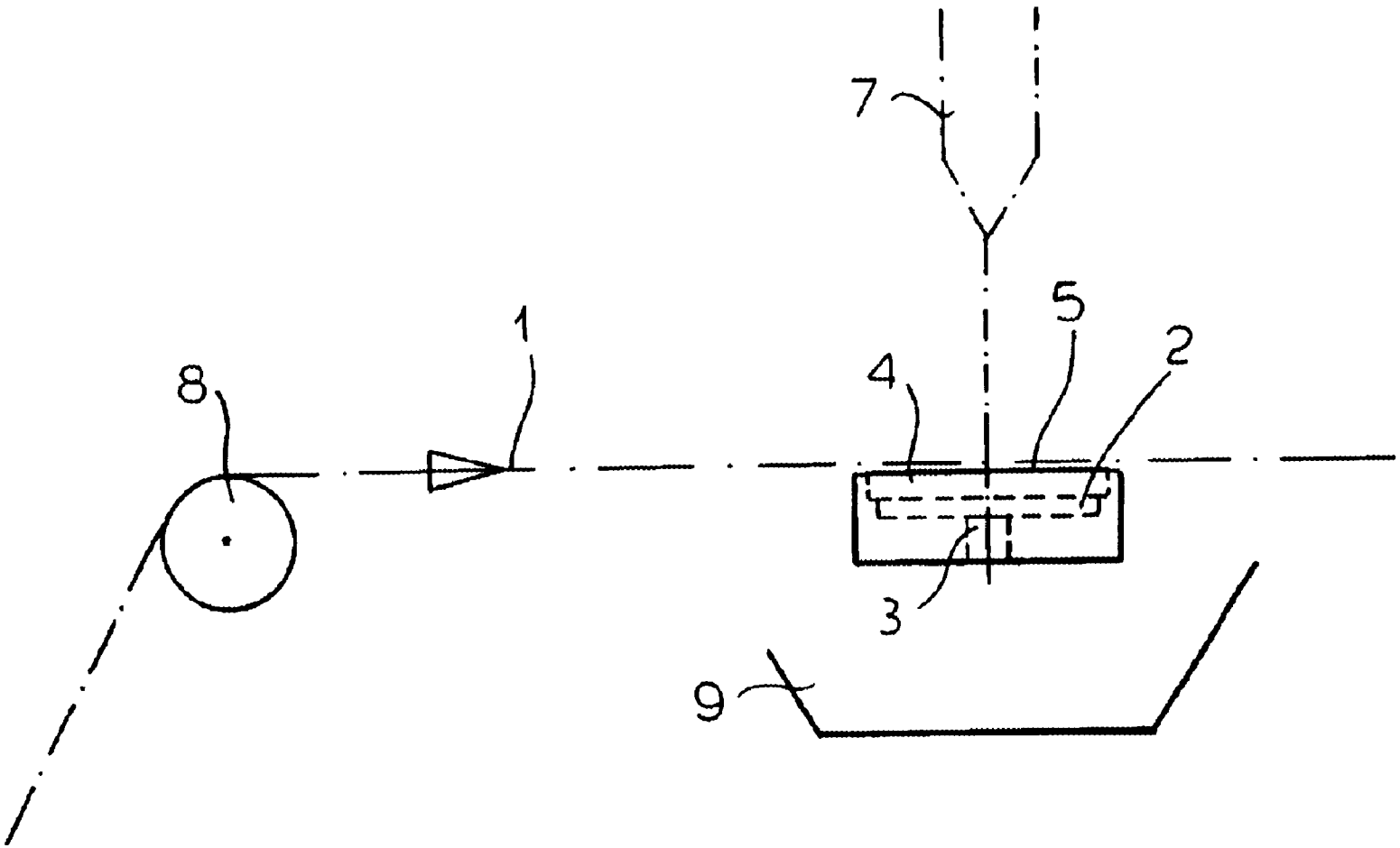
FIG. 3 shows the use of an element according to FIGS. 1 and 2 in a coating system.

The coating apparatus shown in FIG. 3 serves for applying coating materials to a paper web or plastic foil, for example of dispersion adhesives on a web-separation material for making self-adhering labels. Other applications are the application of a barrier layer on a web-shaped base material for making a waterproof packing material or the application of paint in the finishing of paper or cardboard webs.

The coating assembly is a slit nozzle that is connected to an unillustrated supply for the coating material and that has on its lower side a slot-shaped opening extending transverse to the web-travel direction. The coating material emerges from the opening and forms a free-falling curtain that lands on the upper surface of the web 1. The web 1 is deflected by a deflecting roller 8 into a generally horizontal travel path and thus is guided at the desired spacing through the region below the nozzle 7. In the region of the nozzle 7, the back side of the web 1 is supported and guided without contact by the apparatus shown in FIGS. 1 and 2. The planar outer surface 5 of the gas-permeable wall 4 extends as a guide surface of the web 1 parallel to the desired web travel direction and perpendicular to the direction the coating material falls in. Underneath the support device 8 is a catch trough 9 that catches the coating material if the web tears. The web 1 floats on a cushion of air that is produced on the outer face of the wall 4 by feeding compressed air of a few bars pressure into the chamber 2 and expelling it through the porous wall 4. The thus produced compressed-air cushion has the further considerable advantage that it automatically cleans the guide surface: Any coating material falling on the guide surface, for example when the web tears, slides off the air cushion without dirtying the guide surface or plugging in any of the pores of the wall 4.

Figure 4:
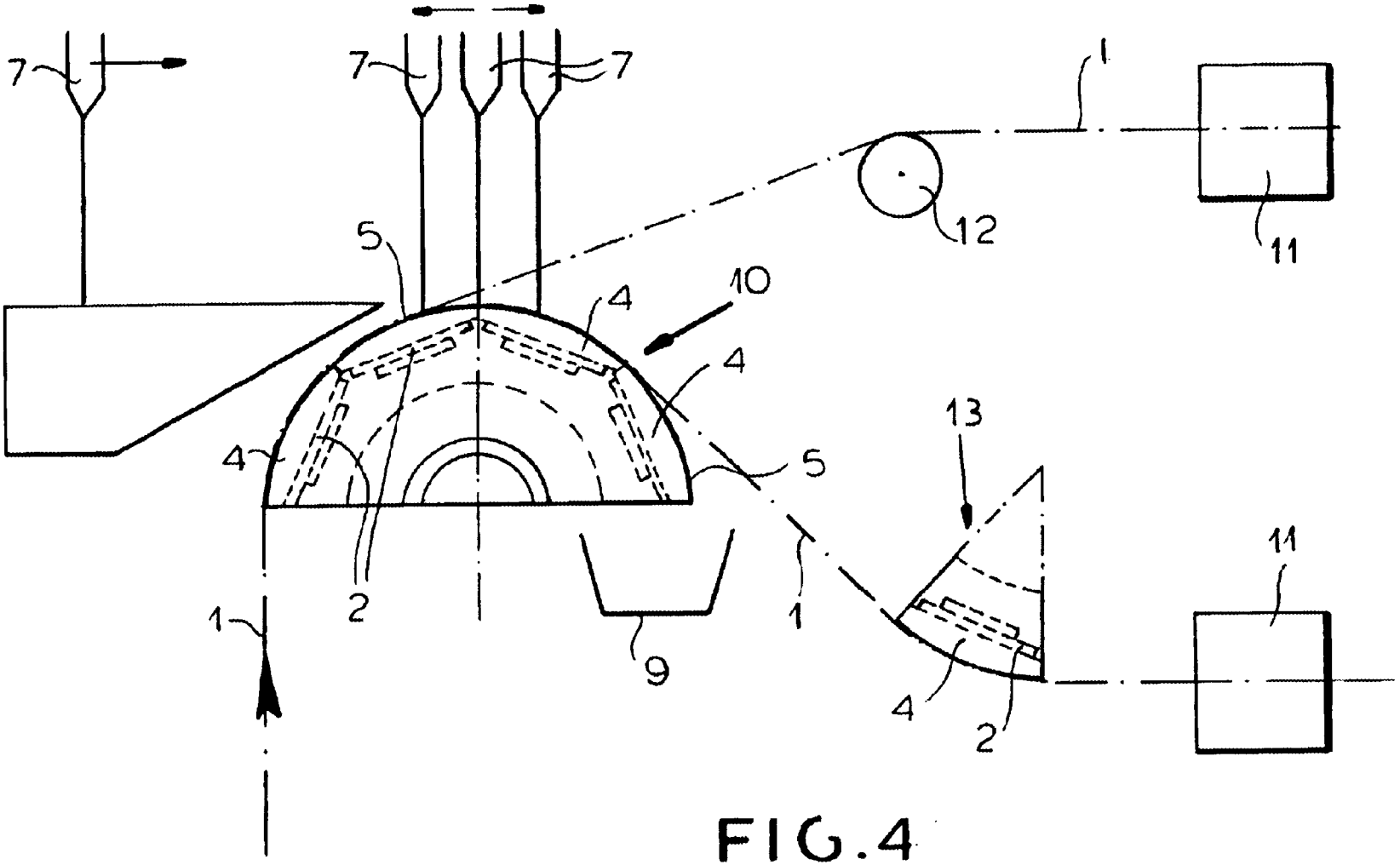
FIG. 4 schematically shows a coating system with a support apparatus and a downstream deflecting device.

FIG. 4 shows the construction of a support and guide apparatus 10 that supports and guides the web 1 in a coating system underneath a slit nozzle 7 through an arcuate path. The support apparatus 10 is formed of several chambers 2 that each have an outer side formed by a porous wall 4, the outer surface 5 of each wall 4 being cylindrically curved. The individual walls 4 are set immediately adjacent one another in the web-travel direction so as to form a support surface that is arcuately curved and continuous over the necessary transport path. A common holder frame 6 for all the chambers and walls is formed as a cylindrical drum and extends like the porous walls 4 over the entire web width.

Two alternative web paths downstream of the slit nozzle 7 to a dryer 11 are shown in FIG. 4: If the position of the dryer makes it possible to guide the web 1 to the dryer 11 after application of the coating material so it does not have to be contacted on the coated side, the web 5 can be guided along the path by rollers 12 that are on the uncoated side. This web path is shown in the top of FIG. 4. The use of guide rollers is however not possible when the web 1 must be deflected on the coated side after coating on the way to the dryer as shown in the bottom of FIG. 4. Here the web 1 is deflected by a contact-free deflecting apparatus 13 that is advantageously in principle constructed as described with reference to the embodiments of FIGS. 1 and 2: A chamber 2 connected to a pressurized-air supply has on the side turned toward the web a wall 4 of the described porous material. The outer surface of the wall 4 is here cylinder shaped as in the support apparatus 10. For large deflection angles several chambers 1 can be arranged one after the other. The web 1 is deflected without contact, floating on an air cushion and passing through the necessary angle to the dryer 11.

Figure 5:
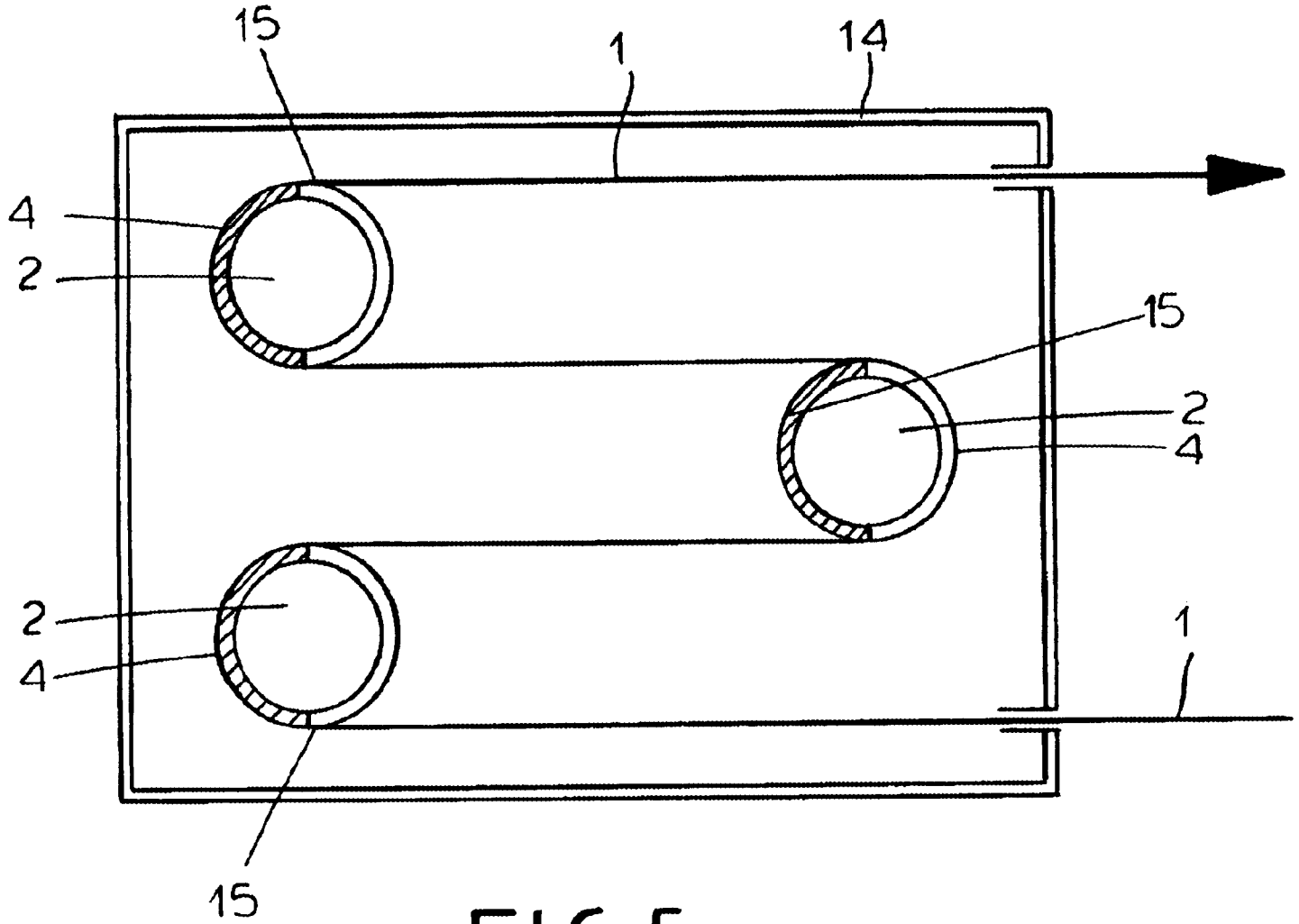
FIG. 5 schematically shows a wetting apparatus.

FIG. 5 shows schematically the construction of a rewetting apparatus that serves after drying to set in a material web 1 a predetermined moisture content throughout the web 1. Overly dry or irregularly dry webs of paper, cardboard, or plastic (in particular cellophane) have a tendency to curl (curling effect). In order to avoid this a uniform residual moisture constant between 4% and 8% is set by rewetting. Normally the rewetting is done with steam that is blown out of nozzles against the web 1. This is difficult, in particular at high web-travel speeds of more than 500 m/min, due to the surface air layer. It prevents sufficient quantities of steam from reaching and condensing on the web 1.

The invention makes it possible to support the web 1 on a cushion of air and steam so that the steam is forced at substantial pressure at high web speeds into the web 1. In addition it is possible to cool the web on its back side in order to increase the condensation of steam on the web 1. Preferably the web 1, as shown in FIG. 5, is guided in a meander through the rewetting apparatus in order to increase the treatment time in a confined space and simultaneously to exert considerable tension on the web.

The rewetting system according to FIG. 5 is formed of a steam-tight housing 14 in which several web-guiding and -wetting elements 15 are arranged so that the web 1 moves along a meander in the housing 14. Each web-guiding and -wetting element 15 has a tubular shape with a gas-permeable wall 4 in the region 1 over which the web 1 is looped. In the region over which the web 1 is looped the tube wall is formed of the porous metal-containing material as described with reference to the embodiments of FIGS. 1 and 2. The interior of the tube is supplied with a mixture of steam and air that moves outward through the wall 4 to form a cushion on which the web 1 floats. The steam perfuses into the web and condenses.

Figure 6:
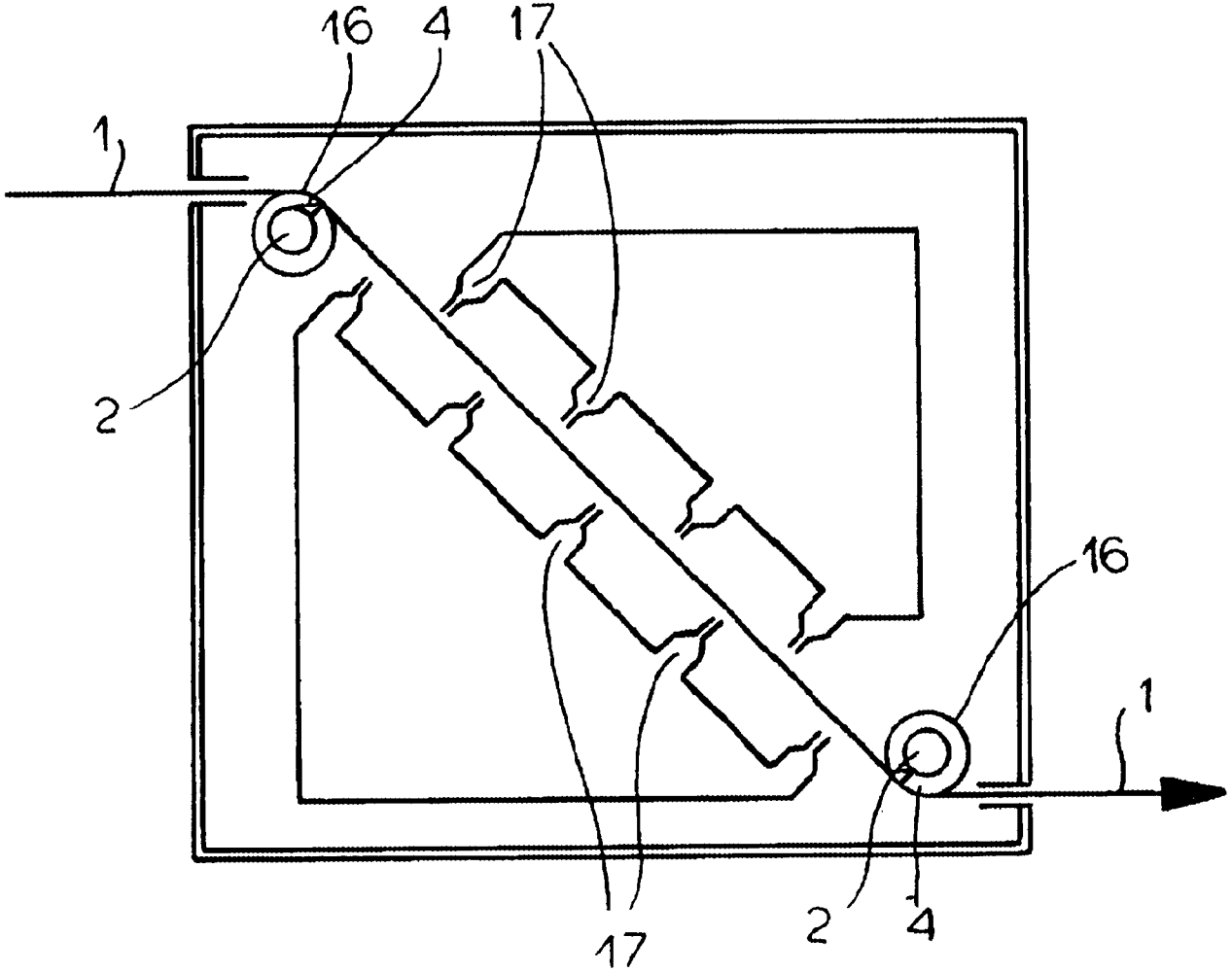
FIGS. 6 through 8 schematically show the construction of a wetting or drying apparatus with web-guide elements according to the invention.
Figure 7:
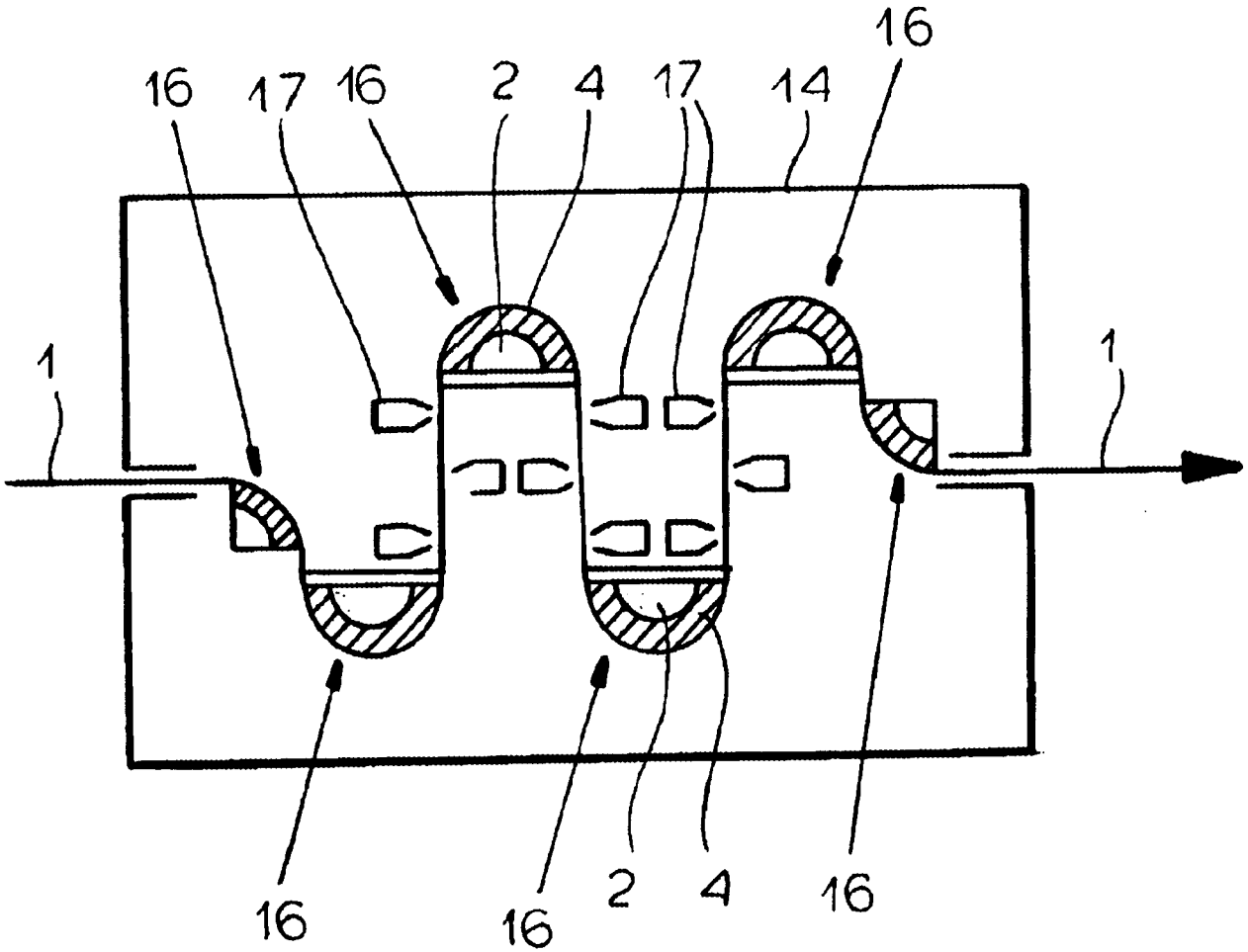

FIGS. 6 and 7 show apparatuses where the web-guiding elements 16 serving to guide the web 1 serve as dryer or rewetting apparatus. Hot air (with the dryer) or steam (with the rewetting apparatus) is directed by nozzles 17 against both faces of the web 1. Whereas in the embodiment of FIG. 6 the web runs straight through the housing 14 of the dryer or rewetting apparatus, in the embodiment of FIG. 7 the web-guiding elements 16 are so arranged and constructed that the web is deflected as a meander through 180°. The web-guiding elements 16 have in the regions over which the web 1 is looped porous walls 4 with the above-described characteristics. In order to form an air cushion between the web 1 and the wall 4 of the guide elements 16 either compressed air or steam or a mixture of the two is fed to the chambers 2 formed inside the guide elements 16 and then moves outward through the walls 4.

Figure 8:
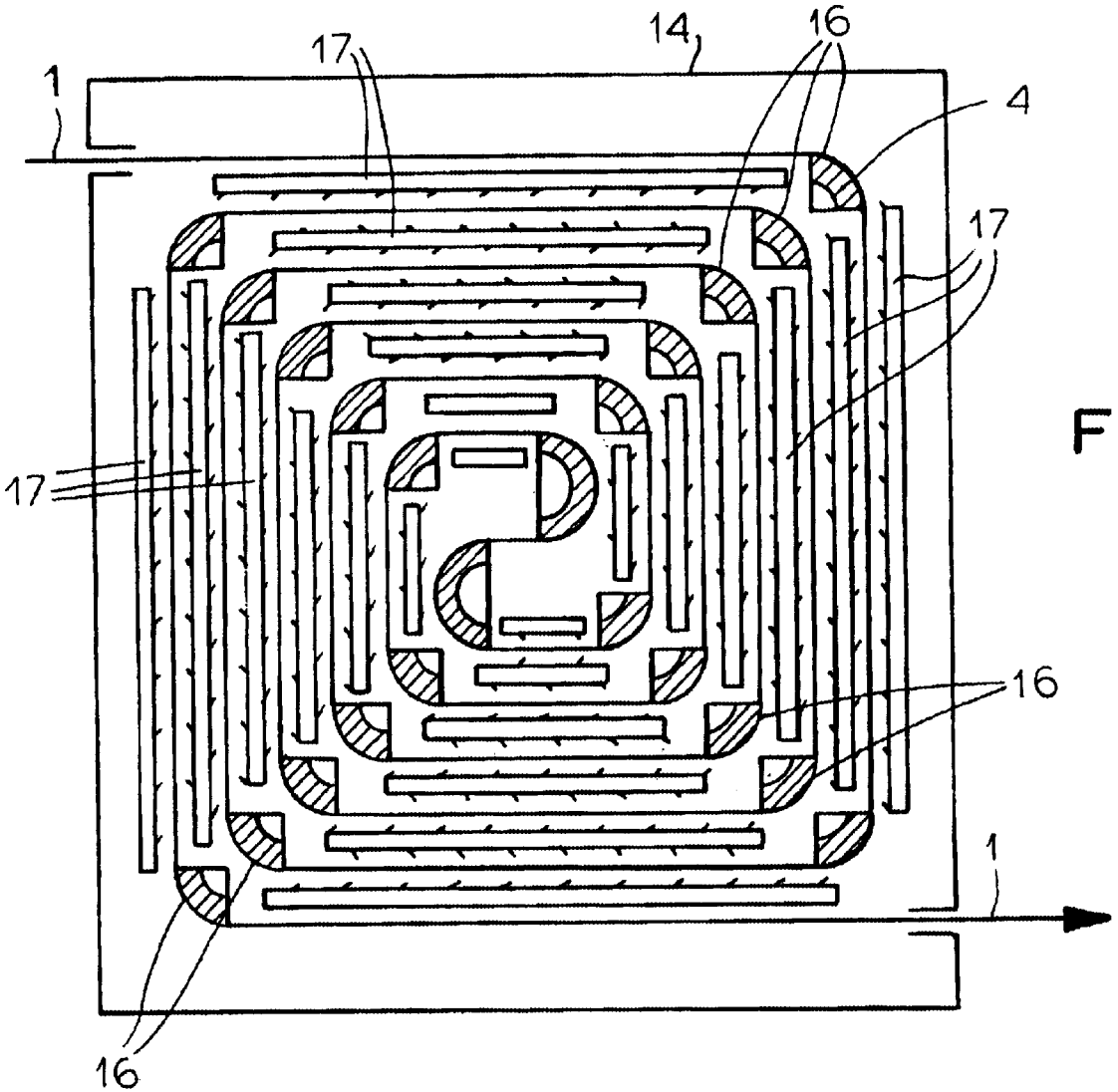

FIG. 8 shows a particularly compactly built drying or rewetting apparatus where in order to treat the web it is guided inside the housing 15 through an extremely long path. The web 1 is initially guided inward in a spiral, then is reversed and again guided outward through another spiral before it leaves the housing 14. In order to guide the web 1 in spirals, web-guiding elements 16 are provided on diagonals of the housing and each serve to deflect the web 1 through 90°. The web-guiding elements 16 have in the supporting region a porous wall 4 through which flows compressed air for forming an air cushion for the contact-free guiding of the web 1. In the center of the housing 14 are two semicylindrical web-guiding elements 16 over which the web 1 is looped through 180° in order to be guided outward again in a spiral in the opposite direction. Along each of the free stretches between two web-guiding elements 16 are nozzles 17 from which a treatment medium flows against both web faces. If the web is to be dried, the treatment medium is hot air. If the apparatus serves for rewettting, steam or a steam/air mixture flows out of the nozzles 17 against both web faces.

Figure 9:
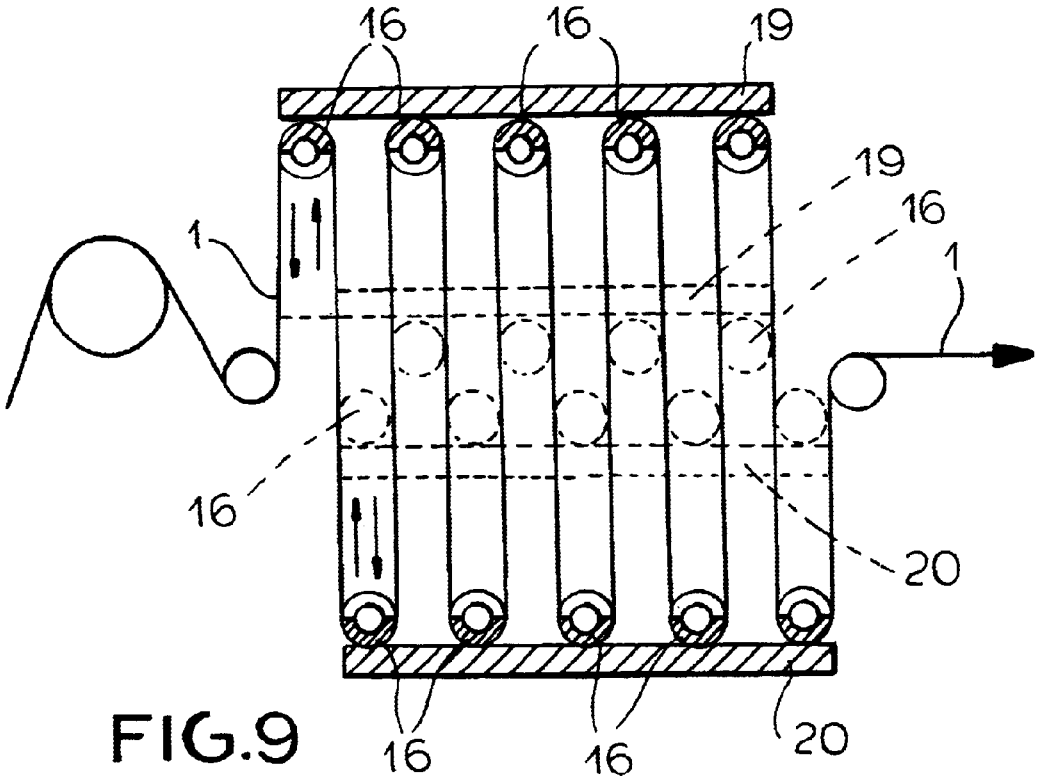
FIG. 9 schematically shows the construction of a web storage system.

FIG. 9 shows a web-storage unit using the web-guiding elements according to the invention. The web storer comprises as is known web-guiding elements that are movable in frame parts 19 and 20 mounted to move toward and away from each other. The web-guiding elements 16 are the above-described elements that have porous walls 4 over which the web is looped over 180°. Each frame part 19 or 20 carries a row of web-guiding elements over which the web is engaged in a back-and-forth path. If the frame parts 19 and 20 are moved toward each other, the free web stretches are shortened between the two adjacent guide elements 16. In this manner a stored length of web is given up by the web storer. In order to store a predetermined length of web the two frame parts 19 and 20 are moved apart.

A further advantageous application possibility for a web-guiding apparatus according to the invention is in transversely spreading material webs. Transverse-spreading apparatus are used as is known in order to produce tension perpendicular to the web edges so that no longitudinal waves or folds are formed in the webs.

Figure 10:
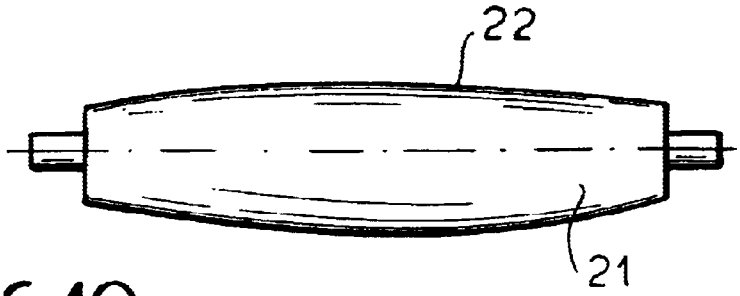
FIGS. 10 and 11 each show a cross spreading apparatus.
Figure 11:
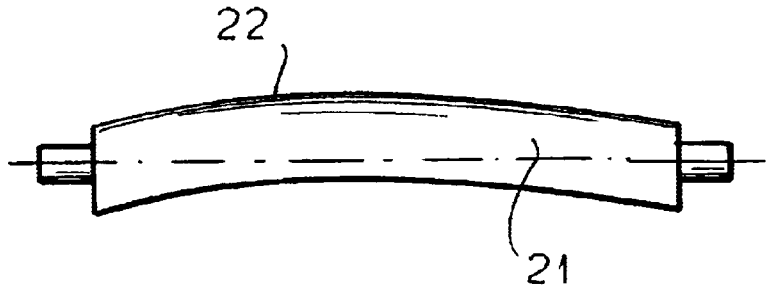

According to the invention the web-spreading apparatus is formed of a tubular base body 21 whose outer surface is bowed as is known, so that its tube wall 22 forms an outwardly convex curve over the width of the web (FIG. 10). Instead of an outwardly convex shape the cylindrical tube wall 22 can be curved over its entire length so as to have an arcuate center axis as shown in FIG. 11. The tube wall 22 is formed over all or part of its circumference from the described porous material so that the web 1 when moving around floats on an air cushion. The invention offers the possibility of forming the convexity differently over the circumference of the tubular base body 21 in order to be able to vary the spreading effect.

What is claimed is:

1. In an apparatus through which a flexible web moves continuously in a travel direction, a guide comprising:

a generally closed chamber having a wall having in turn an outer surface over which the web passes, the wall being formed over the entire outer surface with pores having an average diameter of less than 500 $\mu$m, the pores having at the surface a total flow cross section equal to less than 20% of a total surface area of the outer surface; and means for pressurizing the chamber with a gaseous fluid and for thereby forcing the fluid through the wall and forming between the outer surface a fluid cushion holding the web out of direct contact with the wall.

2. The guide defined in claim 1 wherein the pores have an average diameter of less than 100 $\mu$m.

3. The guide defined in claim 2 wherein the pores have an average diameter of less than 20 $\mu$m.

4. The guide defined in claim 1 wherein the wall is formed of a composite of a thermosetting resin and a metal.

5. The guide defined in claim 4 wherein the metal is aluminum.

6. The guide defined in claim 1 wherein the total flow cross section is equal to less than 10% of the total surface area.

7. The guide defined in claim 1 wherein the surface is planar.

8. The guide defined in claim 1 wherein the surface is convexly arcuate toward the web.

9. The guide defined in claim 1, further comprising means for applying a coating to the web upstream of the wall.

10. The guide defined in claim 1, further comprising means for drying the web adjacent the wall.

11. The guide defined in claim 10 wherein the gaseous fluid includes steam.

12. The guide defined in claim 1 wherein the guide includes a plurality of the walls positioned to deflect the web through a meander.

13. The guide defined in claim 1 wherein the guide includes a plurality of the walls positioned to deflect the web through a spiral.

14. The guide defined in claim 1 wherein the surface is convex toward the web both in and transverse to the direction, whereby the web is transversely spread as it passes over the surface.

* * * * *